United States Patent [19]

Curry

[11] 3,999,258

[45] Dec. 28, 1976

[54] FASTENER FOR PLASTIC FILM SHEETING AND THE LIKE

[76] Inventor: Walter J. Curry, 337 Roberta Ave., Winnipeg, Canada

[22] Filed: Nov. 28, 1975

[21] Appl. No.: 636,129

[52] U.S. Cl. ..... 24/243 K
[51] Int. Cl.[2] ..... A44B 21/00
[58] Field of Search ..... 24/243 K, 243 M, 72.5

[56] References Cited

UNITED STATES PATENTS

| | | | |
|---|---|---|---|
| 3,225,407 | 12/1965 | Daniels | 24/243 K |
| 3,384,938 | 5/1968 | O'Connor | 24/243 K |
| 3,543,326 | 12/1970 | Rohrberg et al. | 24/243 K UX |
| 3,803,671 | 4/1974 | Stuppy et al. | 24/243 K |
| 3,805,873 | 4/1974 | Bloomfield | 24/243 K X |
| 3,893,212 | 7/1975 | Curry | 24/243 K |

*Primary Examiner*—Donald A. Griffin
*Attorney, Agent, or Firm*—Stanley G. Ade

[57] ABSTRACT

An extruded plastic channel receives the plastic film and a plastic locking strip is then engaged within the channel and under opposed overhanging beads on each side of the channel to clamp the film in position. One of the beads on the channel extends inwardly substantially parallel to the base of the channel and the other bead extends upwardly and inwardly and is connected by a relatively thin web, to the side wall of the channel. This last mentioned bead flexes outwardly as the locking strip is snap engaged within the channel. A flexible extension is formed on the underside of the first bead and extends downwardly and towards the side wall from which this bead extends. This presses against the bead of the locking strip when in place and maintains the locking strip firmly in position regardless of the thickness of film used thus enabling the device to be used effectively with films of different thicknesses. In one embodiment, a further flexible extension extends upwardly from the base of the channel and towards the wall from which said one of the beads extends.

8 Claims, 2 Drawing Figures

FASTENER FOR PLASTIC FILM SHEETING AND THE LIKE

BACKGROUND OF THE INVENTION

This invention relates to new and useful improvements in fasteners for plastic film sheeting and the like and is an improvement over my U.S. Pat. No: 3,893,212 which issued July 8th, 1975.

One of the disadvantages of the previous construction is the fact that it is designed primarily for use with film of a given thickness. This means that if a thinner film is used, there is likely to be some slack between the film, the locking strip and the channel which enables the film to be pulled through the channel and thus loosened.

SUMMARY OF THE INVENTION

The principle object and essence of the invention is therefore to provide a locking device for plastic film which enables the locking strip to be engaged with the film and then snapped easily in place within the locking channel and to remain taut regardless of the thickness of the film used, within limits.

Another object of the invention is to provide a device of the character herewithin described in which one of the beads of the locking channel is easily displaced outwardly to enable the locking strip to be snapped into position whereupon the bead returns thus holding the locking strip firmly in position.

Another object of the invention is to provide a device of the character herewithin described which includes flexible extension means adapted to maintain tension upon the locking strip when in position within the channel thus maintaining the locking strip firmly in position and in contact with the film engaged therearound.

Another object of the invention is to provide a device of the character herewithin described which is simple in construction economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
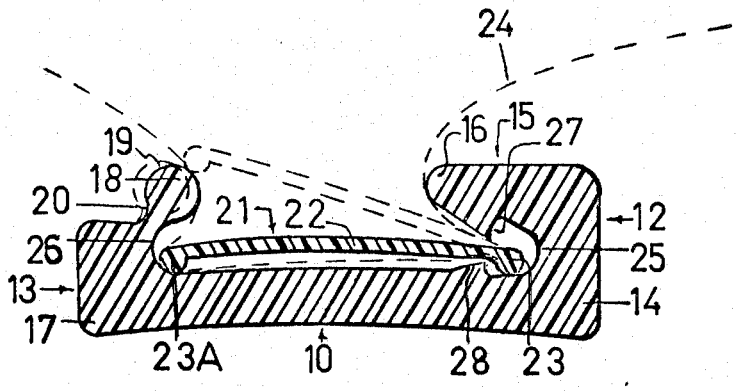
FIG. 1 is a cross sectional view of a portion of the locking device showing the locking strip in position and the film being shown in phantom.
Figure 2:
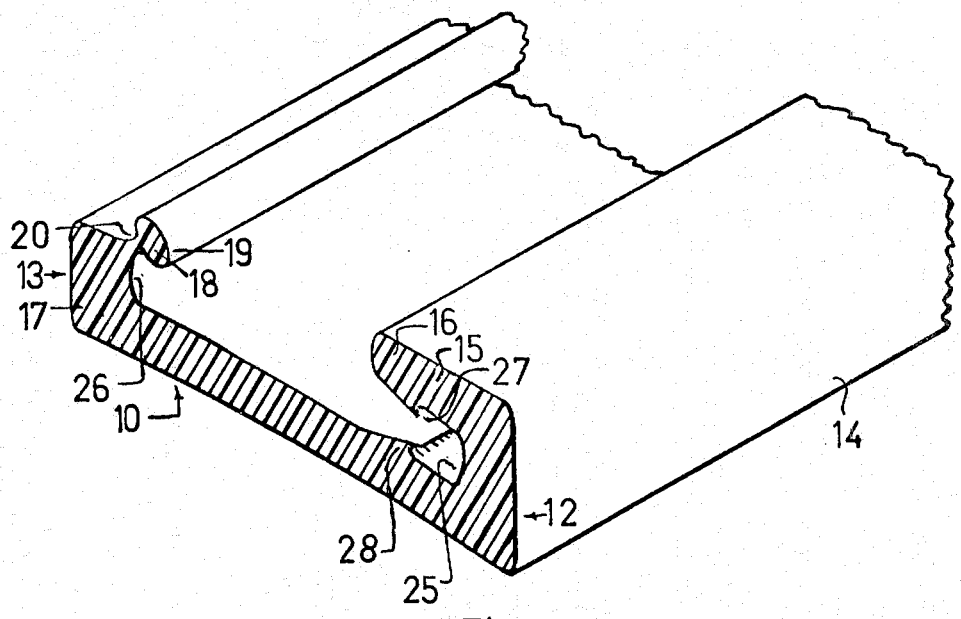
FIG. 2 is an fragmentary isometric view of a portion of the locking channel per se.

Proceeding therefore to describe the invention in detail, reference character 10 illustrates an elongated channel member preferably made of flexible plastic and including an elongated base 11, an elongated side wall construction 12 on one side of the base and a further elongated side wall construction 13 on the other side of the base 11.

The elongated side wall construction 12 includes a wall portion 14 which extends upwardly substantially at right angles from the plane of the base 11 and then turns inwardly to run substantially parallel with the plane of the base being indicated by reference character 15.

The inner edge of this portion 15 is formed with a bead 16.

The opposite side wall construction 13 includes a portion 17 which extends perpendicular to the plane of the base 11 and then inclines inwardly and upwardly to form the elongated portion 18.

This portion 18 includes an elongated bead 19 connected to the upper edge of the portion 17 by a relatively thin web 20 thus allowing the bead 19 to be deflected outwardly to the position shown in phantom in FIG. 1 with the resiliency of the material returning the bead 18 to the position shown in FIG. 1 in solid line, after the cause for the deflection has been removed.

An elongated locking strip collectively designated 21 is provided and includes an elongated web 22 having an elongated bead 23 and 23A formed one upon each edge of the web 22.

It is desirable that the web be formed in a concave-convex configuration although this is not absolutely necessary.

In operation, the film shown in phantom by reference character 24 is engaged around the locking strip whereupon the bead 23 is engaged under the portion 16 of the channel member and snugged into the recess 25 formed by the side wall construction 12 and the base 11.

The other bead 23A is then pushed downwardly until it engages the bead 19 so that further pressure displaces this bead outwardly towards the position shown in phantom thus allowing bead 23A to be snapped into position into the recess 26 formed by the side wall portion 17 and the base 11.

Normally the channel member and locking strip are sized to receive a film of a given thickness but it is often necessary to utilize films that are thinner than normal.

In order to prevent any looseness developing, an elongated flexible extension 27 is formed on the underside wall of the portion 15 of the side wall construction 12, said flexible extension extending downwardly and inwardly towards the wall portion 14 of the side wall construction 12. This presses against the junction between the web 22 and bead 23 of the locking strip and forces it into position to take up any slack which might be present due to a thinner film being utilized.

A similar flexible extension 28 may be provided on the base 11, said flexible extension 28 extending upwardly and towards the junction between portions 14 and 15 of the side wall construction 12. Once again this flexible extension 28 presses against the film 24 and thence against the web 22 and holds same firmly in position if a thinner film is being used. If a thicker film is being used and of course these flexible extensions 27 and 28 flexs apart from one another and allow the thicker film to be engaged around the locking strip and within the channel member.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A clamping and holding assembly for flexible plastic film sheeting and the like, comprising in combination an elongated flexible channel member, an elongated locking strip detachably engageable within said channel member for clamping the associated film therebetween, and means co-operating between said locking strip and said channel member for detachably securing said strip within said channel member, said means including said channel member having a base and a pair of side walls extending upwardly from said base one upon each side edge thereof, one of said side walls extending upwardly and then inwardly of the corresponding side edge of said base and substantially parallel to said base, the other of said side walls extending upwardly substantially perpendicular to said base and then inclining upwardly and inwardly, the portion of said other side wall inclining upwardly and inwardly being flexible relative to the remaining portion of said other side wall, said portion of said other side wall which inclines upwardly and inwardly, being capable of being displaced outwardly against pressure of said locking strip entering said channel member and returning to the normal position after said locking strip is engaged within said channel member, and a flexible extension formed on the underside of the portion of said one side wall which extends inwardly, said flexible extension inclining downwardly and towards the portion of said one side wall which extends upwardly from said base.

2. The device according to claim 1 in which said other side wall terminates in an elongated bead, said bead being flexibly connected to the remaining portion of said other side wall, and a relatively thin web connecting said bead to said remaining portion of said other side wall.

3. The device according to claim 2 in which said elongated locking strip includes an elongated web and an elongated bead formed on each edge of said web.

4. The device according to claim 1 in which said elongated locking strip includes an elongated web and an elongated bead formed on each edge of said web.

5. A clamping and holding assembly for flexible plastic film sheeting and the like, comprising in combination an elongated flexible channel member, an elongated locking strip detachably engageable within said channel member for clamping the associated film therebetween, and means co-operating between said locking strip and said channel member for detachably securing said strip within said channel member, said means including said channel member having a base and a pair of side walls extending upwardly from said base one upon each side edge thereof, one of said side walls extending upwardly and then inwardly of the corresponding side edge of said base and substantially parallel to said base, the other of said side walls extending upwardly substantially perpendicular to said base and then inclining upwardly and inwardly, the portion of said other side wall inclining upwardly and inwardly being flexible relative to the remaining portion of said other side wall, said portion of said other side wall which inclines upwardly and inwardly, being capable of being displaced outwardly against pressure of said locking strip entering said channel member and returning to the normal position after said locking strip is engaged within said channel member, said other side wall terminating in an elongated bead, said bead being flexibly connected to the remaining portion of said other side wall, and a relatively thin web connecting said bead to said remaining portion of said other side wall.

6. The device according to claim 5 which includes a flexible extension formed on the underside of the portion of said one side wall which extends inwardly, said flexible extension inclining downwardly and towards the portion of said one side wall which extends upwardly from said base.

7. The device according to claim 6 in which said elongated locking strip includes an elongated web and an elongated bead formed on each edge of said web.

8. The device according to claim 5 in which said elongated locking strip includes an elongated web and an elongated bead formed on each edge of said web.

* * * * *